US006014825A

United States Patent [19]

Jahn et al.

[11] Patent Number: 6,014,825

[45] Date of Patent: Jan. 18, 2000

[54] BUCKET WHEEL EXCAVATOR

[75] Inventors: Dieter Jahn, Magdeburg; Bernhard Wiechers, Bad Oeynhausen, both of Germany

[73] Assignee: Krupp Fordertechnik GmbH, Essen, Germany

[21] Appl. No.: 09/185,105

[22] Filed: Nov. 3, 1998

[30] Foreign Application Priority Data

Nov. 7, 1997 [DE] Germany ..... 197 49 246

[51] Int. Cl.[7] ..... E02F 5/08

[52] U.S. Cl. ..... 37/91; 37/190; 37/95; 172/518

[58] Field of Search ..... 37/305, 91, 92, 37/386, 393, 462, 189, 190, 95, 94; 172/518, 540, 818, 819

[56] References Cited

U.S. PATENT DOCUMENTS

| | | | |
|---|---|---|---|
| 1,072,731 | 9/1913 | Jordan . | |
| 2,708,800 | 5/1955 | Logus | 37/305 |
| 2,748,505 | 6/1956 | Turner . | |
| 3,539,022 | 11/1970 | Berg | 172/819 |
| 3,972,406 | 8/1976 | MacDonald . | |
| 3,974,580 | 8/1976 | Satterwhite | 37/189 |
| 3,982,340 | 9/1976 | Satterwhite | 37/190 |
| 4,069,605 | 1/1978 | Satterwhite | 37/91 |
| 4,156,977 | 6/1979 | Satterwhite | 37/190 |
| 4,955,151 | 9/1990 | Bryan | 37/190 |
| 4,999,022 | 3/1991 | Veys | 172/819 |
| 5,058,294 | 10/1991 | Bryan, Jr. | 37/189 |
| 5,060,732 | 10/1991 | Baskett | 171/63 |
| 5,092,657 | 3/1992 | Bryan, Jr. | 37/189 |
| 5,228,220 | 7/1993 | Bryan, Jr. | 37/364 |

FOREIGN PATENT DOCUMENTS

| | | |
|---|---|---|
| 1 634 722 | 8/1970 | Germany . |
| 26 29 364 | 1/1977 | Germany . |
| 26 31 176 | 2/1977 | Germany . |
| 36 38 423 A1 | 7/1987 | Germany . |
| 2 242 463 | 10/1991 | United Kingdom . |

*Primary Examiner*—Thomas B. Will
*Assistant Examiner*—Kristine Markovich
*Attorney, Agent, or Firm*—Herbert Dubno

[57] ABSTRACT

A bucket wheel excavator has a scraper blade mounted on the bogie and whose height is independent of the raising and lowering of the bucket wheel to maintain a level track for the crawler bogie. The scraper blade can be tilted about a horizontal axis by at least one hydraulic cylinder.

3 Claims, 3 Drawing Sheets

BUCKET WHEEL EXCAVATOR

FIELD OF THE INVENTION

Our present invention relates to a bucket wheel excavator and, more particularly, to a bucket wheel excavator of the type in which a bucket wheel is mounted at an end of a crawler bogie, i.e. is positioned ahead of the latter in a forward direction.

BACKGROUND OF THE INVENTION

U.S. Pat. No. 2,748,505 describes a loading apparatus with a raisable and lowerable cutting wheel provided with cutting and receiving elements for the excavated material which is positioned at an end, i.e. the front end, of a crawler bogie so as to be advanced ahead of the crawler bogie which is displaced along the ground.

Between the cutting and receiving elements of the cutter wheel, on the one hand, and the crawler bogie on the other hand, a blade extends which can transport material which has been dropped off, once again in the direction of the receiving elements of the wheel in cooperation with the obliquely disposed cutter elements thereof.

The blade can be articulated to the bogie by means of lever arms and can also be connected to the boom of the cutter wheel for raising and lowering therewith. When the cutter wheel is lifted, therefore, the blade is automatically raised and essentially maintains its position in relation to the cutting and receiving elements so that any material falling from the cutting wheel can drop to the ground to the extent that it is not fed to the receiving elements.

As a consequence humps of material can form on the ground which can impede the travel of the crawler bogie and can alter the terrain so that the excavator does not track on a level or maintain level tracking.

Since the level on which the crawler bogie may travel is thus varied, the original tracking level cannot be restored in this earlier system without a lowering of the cutter wheel, which may be undesirable, or clearing the area with other equipment such as a bulldozer or the like.

The conventional blade as described above cannot fulfill this function since it is tied to the cutter wheel boom and cannot be lowered independently.

As a consequence, the blade of U.S. Pat. No. 2,748,505 serves only for the guidance of excavated material to the receiving elements and for assisting the transfer of the excavated material to a downstream hopper which may be provided in the region of the bogie. This transfer is normally overhead.

U.S. Pat. No. 1,072,731 describes receiving elements for the excavated material which is equipped with buckets. In this system, a scraper blade is provided beneath the bogie. The scraper blade is positioned so far from the receiving element that once again material dropped from the receiving element can result in an accumulation or hump at the normal tracking level of the bogie so that here as well deviation from a level tracking cannot be avoided as the front part of the bogie rides up on these accumulations.

OBJECTS OF THE INVENTION

It is an object of the present invention to provide an improved bucket excavator which does not have to be shifted in order to clear its path, even in the case of dropping of excavated material in front of the bogie.

It is a more specific object of the invention to provide a bucket wheel excavator which is self-clearing with respect to inadvertently dumped excavated material, but nevertheless is of simple construction and simple operation and which does not require reversing for track clearance.

Still another object of the invention is to provide an improved bucket wheel excavator which eliminates drawbacks of earlier systems.

SUMMARY OF THE INVENTION

These objects and others which will become apparent hereinafter are attained, in accordance with the invention, by providing the bucket wheel conveyer with at least one scraper blade, spaced from the receiving elements of the bucket wheel, mounted on the bogie, and extending at least laterally beyond the crawler bogie, i.e. beyond lateral limiting edges thereof. The scraper blade is also mounted ahead of the bogie.

More particularly the bucket wheel conveyer of the invention comprises:

- a crawler bogie having an end and a pair of lateral limiting edges;
- a driven bucket wheel and means for mounting the bucket wheel at the end of the bogie so that the bucket wheel is spaced ahead of the bogie, the bucket wheel having a multiplicity of earth-receiving members;
- at least one scraper blade mounted on the bogie at the end and extending laterally of the bogie beyond the lateral limiting edges thereof; and
- means for mounting the scraper blade on the bogie to establish a predetermined spacing between the scraper blade and the receiving members of the bucket wheel.

According to a feature of the invention, the means for mounting the scraper blade on the bogie includes actuating elements, especially hydraulic cylinders, which can raise and lower the blade relative to the crawler bogie and can tilt the blade about a horizontal axis parallel to a longitudinal axis of the blade. The distance of the blade from the receiving elements of the bucket wheel can be varied and advantageously the height of the blade can be predetermined as a function of the slope of the piled excavator material as a function of the spacing between the blade and the bucket wheel. The angle is the natural angle of repose of the excavated material. The height of the blade can be adjustable as well.

With the system of the invention it is possible to maintain an original track level using the scraper blade to deflect any accumulations of material which might drop from the bucket wheel. The material can be deflected toward the receiving members so that it is picked up by the bucket wheel or, alternatively, deflected beyond the lateral edges of the crawler bogie. In any event, material accumulations ahead of the bogie is prevented so that the initial tracking level is not altered as the excavator is advanced.

The distances by which the scraper blade projects laterally beyond the lateral edges of the crawler bogie are such that even in the event of accumulations of the excavated material alongside the track along which the excavator is advanced, this material will be unable to slide back toward the crawler tracks and change the tracking level.

In summary, the system of the invention has the advantages that it avoids the need for additional equipment to clear the track level from accumulations of excavated material, it provides an optimum tracking level for the excavator by independently clearing any rise ahead of the excavator resulting from the excavated material and pushes such accumulations back into the path of the receiving members of the bucket wheel, and it eliminates unevenness ahead of the crawler bogie and thus prevents obstruction of the crawler tracks or damage thereto.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
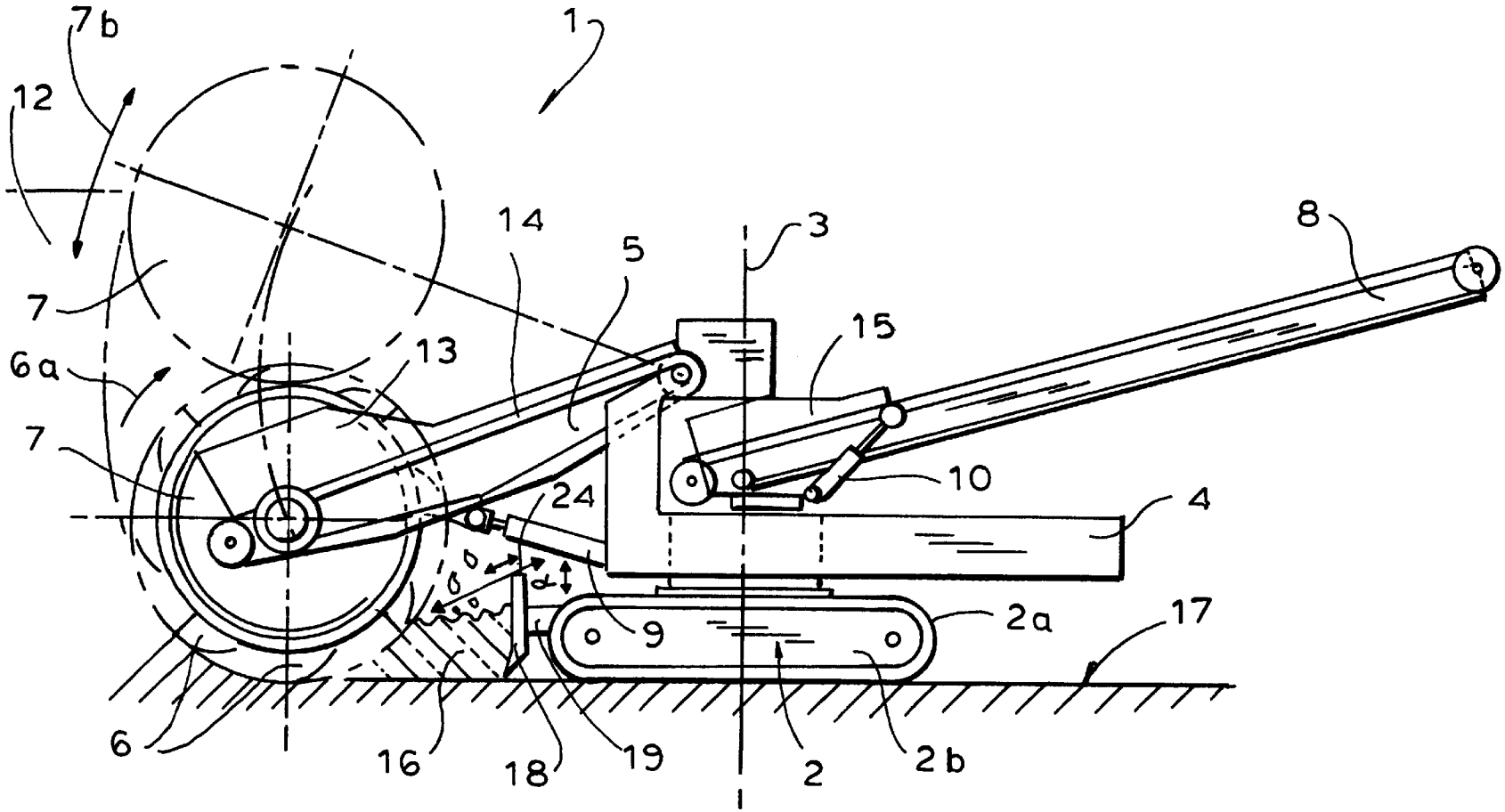
FIG. 1 is a highly diagrammatic side elevational view of a bucket wheel excavator according to the invention.
Figure 2:
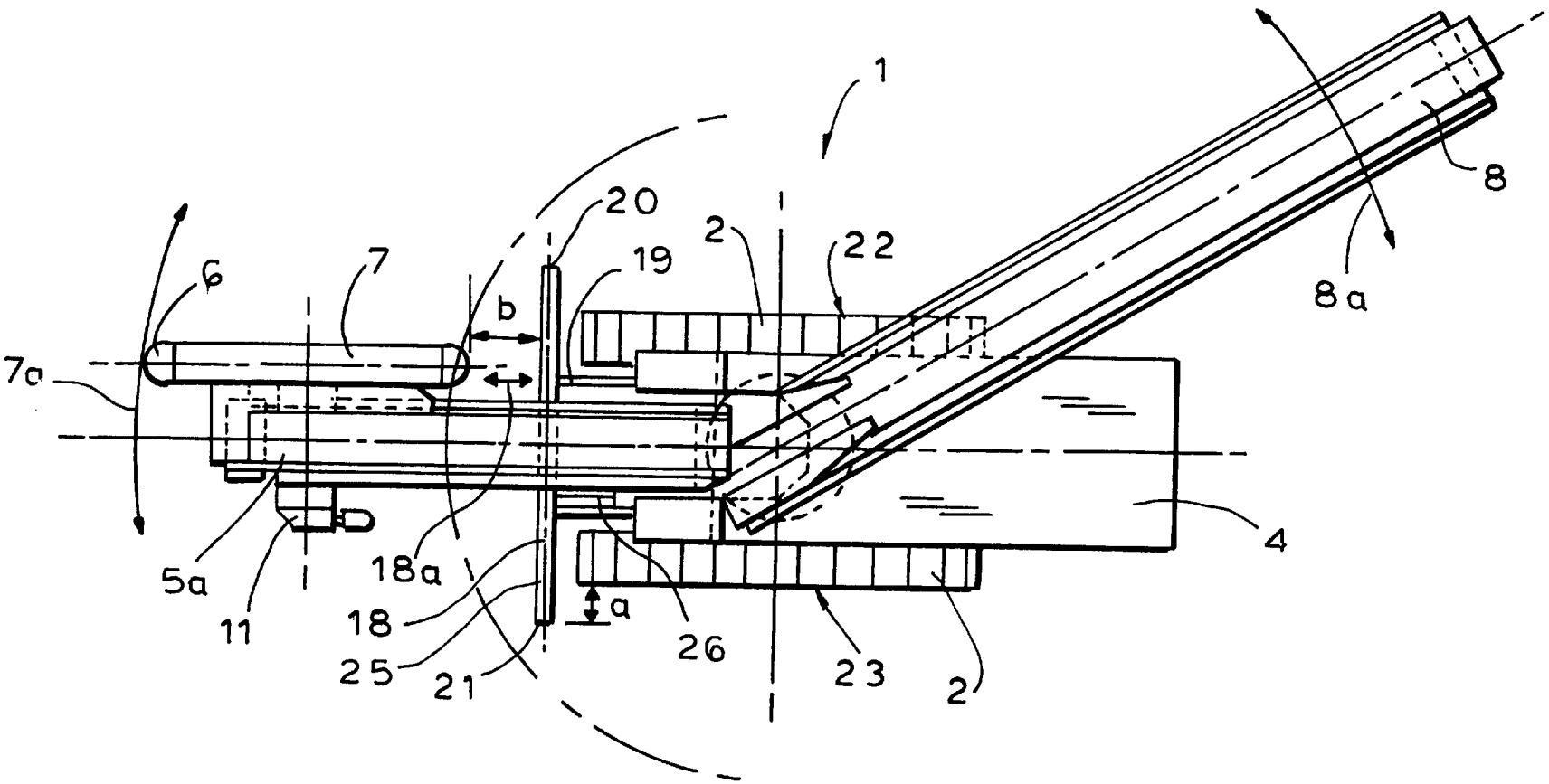
FIG. 2 is a plan view thereof.

In FIGS. 1 and 2 only the main elements of a bucket wheel conveyer have been illustrated and these include the crawler bogie 2 for the excavator 1, the superstructure 4 on the bogie which is rotatable about a vertical axis 3 and which carries a boom 5 with an excavating unit in the form of a bucket wheel 7 provided with receiving members 6 in the form of buckets.

The crawler bogie 2 may comprise endless tracks 2*a* which are displaceable on an undercarriage 2*b* by a drive mechanism and support roller arrangement which is conventional in the art.

The raising and lowering of the boom 5 and hence of the bucket wheel 7 is effected by a hydraulic cylinder 9 which is articulated to the front region of the carriage 4 and to the boom 5.

Another hydraulic cylinder 10 is articulated on the superstructure 4 and to a boom of a conveyer belt 8, hereinafter referred to as the discharge belt. A drive 11 is provided for the bucket wheel 7 and further drives are provided for the tracks 2 and the discharge conveyer 8 which can be swingable as represented by the double-headed arrow 8*a* to control location of the discharged excavated material.

The boom 5 may be swung about the vertical axis as represented by the double-headed arrow 7*a* and can be raised and lowered as represented by the double-headed arrow 7*b*.

As shown diagrammatically in FIG. 1, the excavating or receiving members 6 of the bucket wheel 7 can bite into the slope 12 to be excavated while being rotated in the direction of arrow 6*a* so that the excavated material is transferred from the buckets 6 to a chute 13 on the boom 5 and from which the excavated material is carried by the boom conveyer 5*a* to a chute 15 delivering the material to the discharge conveyer 8. The excavated material can be carried further away by other conveyers if desired.

In operation, the bucket wheel excavator tends to deposit or leave significant amounts of material scattered or deposited at 16 along the track or path 17 of the excavator during mining or excavation. This material may arise from overloading of the bucket wheel, from material collapsing from the slope 12 or as material is partly loosened but bypassed by the bucket.

To clear the tracking path of the excavator from such humps of material, prior to the present invention, the bucket wheel excavator would have to be backed away and a bulldozer or other material-moving machine would have to be used.

Figure 3:
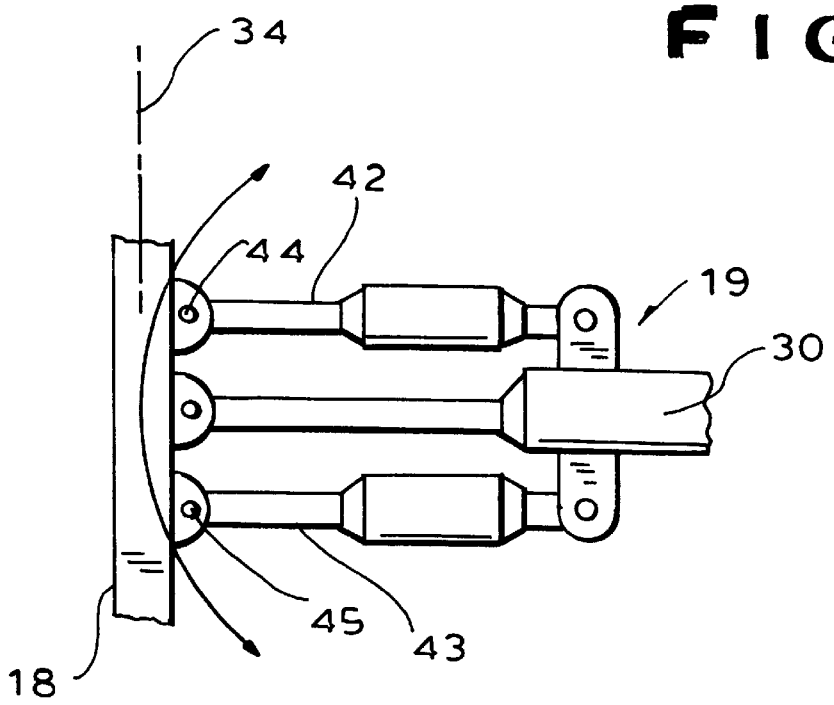
FIG. 3 is a detail view from above of a portion of the mounting means whereby the scraper blade is mounted on the crawler bogie.
Figure 4:
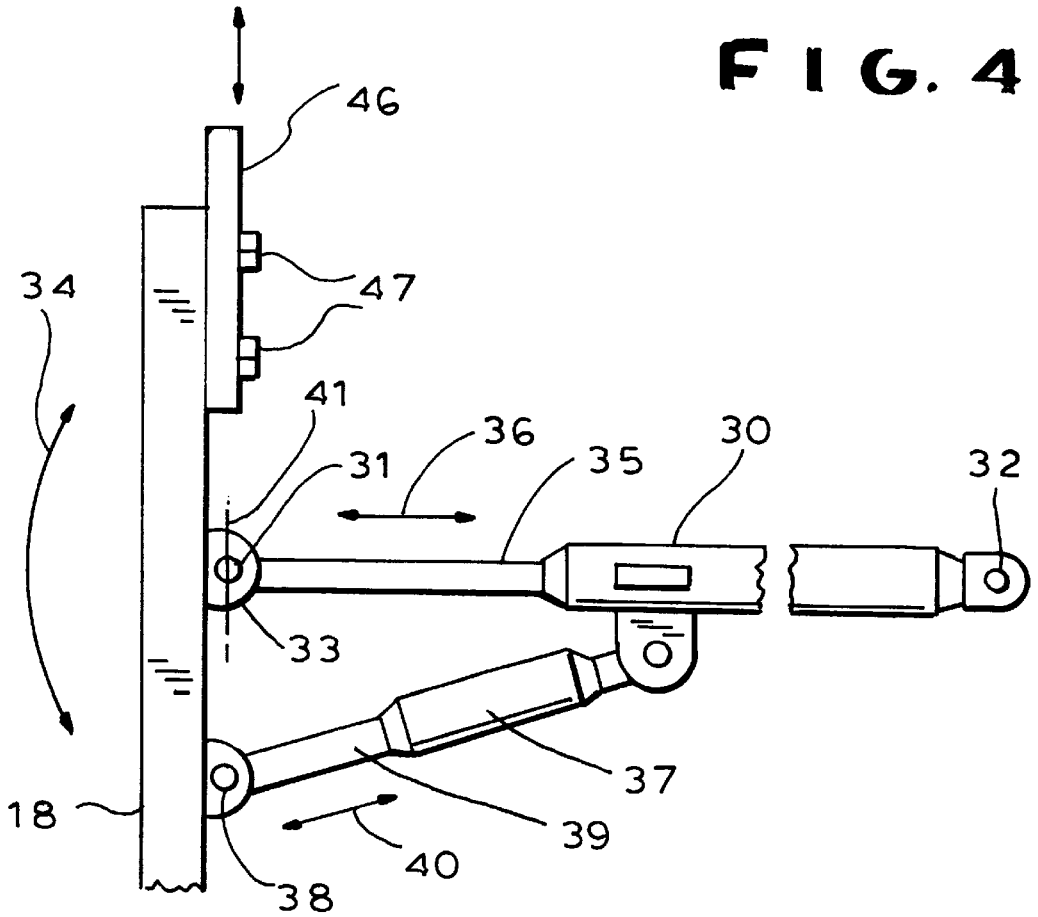
FIG. 4 is a side elevational view of the mounting means.

However, this time-consuming operation is avoided by providing rearwardly of the bucket wheel 7 and spaced from the receiving members 6 a scraper blade 18 which is supported on the crawler bogie 2 by a mounting means represented generally at 19 in FIGS. 1 and 2 and enabling movement of the scraper blade as represented by the arrow 18a, for example, in FIG. 2, i.e. fore and aft, about a horizontal axis as represented by the angle a shown in FIG. 1 and as described more fully in connection with FIGS. 3 and 4.

The lateral limiting edges 20 and 21 of the scraper blade 18 project beyond the lateral limiting edges 22 and 23 of the crawler bogie 2 by a distance a selected so that any material lying laterally of the tracking path of the excavator cannot slide back into the region of the crawler tracks.

The distance b between the scraper blade 18 and the buckets 6 may be constant but can be variable as represented by the arrow 18*a*. If more material tends to accumulate behind the bucket 6, the blade 18 can be moved closer to the buckets.

The mounting means 19 can include, as shown in FIG. 4, hydraulic cylinders 30 which can be connected at ball joints 31 to the blade 18 and at articulations 32 to the crawler bogie 2, the ball joints 31 enabling the scraper blade 18 to tilt about a horizontal axis 33 parallel to a longitudinal axis 34 (FIG. 3) of the blade. The tilt is represented by the double-headed arrow 34 in FIG. 4.

In addition, the distance from the bucket wheel is adjusted by advancing or retracting the piston rod 35 of this cylinder as represented by the double-headed arrow 36. The tilt itself is controlled by a hydraulic cylinder 37 connected by a ball joint 38 to the blade 18 and having a piston rod 39 which can be advanced and retracted as represented by the double-headed arrow 40. The blade 18 can, moreover, be swung about a vertical axis 41 via a pair of hydraulic cylinders 42, 43, each of which is connected by a ball joint 44, 45 to the blade 18 and is articulated to the cylinder 30. The effective height of the blade 18 can be varied by shifting a plate 46 vertically relative to the bolts 47 securing the plate 46 to the blade 18 through vertical slots (not shown) in the plate 46.

Thus the scraper 18 can remove or level accumulations ahead of the blade 18 as the bucket wheel conveyer is advanced or by moving the scraper blade toward the bucket wheel. Material pushed by the-scraper blade 18 into the region of the buckets 6 can be picked up and carried off. The path of the crawler bogie is leveled and wear on the crawler bogie is reduced so that the life expectancy thereof can be increased. The height of the blade 18 is so selected as a function of the distance b from the bucket wheel that material cannot pass over the upper edge 24 even if the blade is tilted as represented by the angle α. The height is adjusted in the manner which has been described as a function of the angle of repose of the material 16 as has already been described.

It has already been noted further that the blade can be tilted about the horizontal axis (33 in FIG. 4 and 25 in FIG. 2) by a suitable hydraulic cylinder (37 in FIG. 4 and 26 in FIG. 2). The mounting units including these cylinders can be provided to either side of the boom 5.

We claim:

1. A bucket wheel excavator comprising:

a crawler bogie having an end and a pair of lateral limiting edges;

a driven bucket wheel and means for mounting said bucket wheel at said end of said bogie so that said bucket wheel is spaced ahead of said bogie, said bucket wheel having a multiplicity of earth-receiving members;

at least one scraper blade mounted on said bogie at said end and extending laterally of said bogie by predetermined distances beyond each said lateral limiting edge thereof; and hydraulic cylinders mounting said scraper blade on said bogie:

for varying a spacing between said scraper blade and said receiving members of said bucket wheel for raising and lowering said scraper blade relative to said crawler bogie, and for inclining said scraper blade about a horizontal axis extending parallel to a longitudinal axis of said scraper blade.

2. The bucket wheel excavator as defined in claim 1, further comprising means enabling establishment of a height of said scraper blade as a function of a slope angle determined from said spacing.

3. The bucket wheel excavator as defined in claim 1, further comprising means for varying the height of said scraper blade.

* * * * *